US006431265B2

(12) United States Patent
Shinhama et al.

(10) Patent No.: US 6,431,265 B2
(45) **Date of Patent: *Aug. 13, 2002**

(54) FLAT TUBES FOR USE WITH HEAT EXCHANGER AND MANUFACTURING METHOD THEREOF

(75) Inventors: Masayoshi Shinhama; Junichi Hiyama; Hiroyuki Tamura; Shinya Kaneko; Enichi Ishiwa; Yoshihiro Sasaki; Yoshiaki Koga, all of Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/898,076

(22) Filed: Jul. 5, 2001

Related U.S. Application Data

(63) Continuation of application No. 09/487,893, filed on Jan. 19, 2000, now Pat. No. 6,267,177.

(30) Foreign Application Priority Data

Jan. 19, 1999 (JP) ..... 11-11113
Jan. 29, 1999 (JP) ..... 11-22771

(51) Int. Cl.[7] ..... F28F 1/02
(52) U.S. Cl. ..... 165/177; 29/890.053
(58) Field of Search ..... 165/177; 29/890.053

(56) References Cited

U.S. PATENT DOCUMENTS

| | | | | |
|---|---|---|---|---|
| 3,502,142 A | 3/1970 | McGuffey | 165/170 |
| 3,783,090 A | 1/1974 | Andersson et al. | 165/166 |
| 4,024,619 A | 5/1977 | Jonason | 29/157.3 |
| 4,781,248 A | 11/1988 | Pfeiffer | 165/167 |
| 5,186,250 A | 2/1993 | Ouchi et al. | 165/177 |
| 5,398,751 A | 3/1995 | Blomgren | 165/166 |
| 5,697,433 A | 12/1997 | Kato | 165/170 |
| 5,765,634 A | 6/1998 | Martins | 165/177 |
| 6,016,865 A | 1/2000 | Blomgren | 165/148 |
| 6,267,177 B1 * | 7/2001 | Shinhama et al. | 165/177 |

FOREIGN PATENT DOCUMENTS

| | | | |
|---|---|---|---|
| DE | 19548495 A1 * | 6/1997 | F28F/1/02 |
| DE | 195 48 495 A1 | 6/1997 | |
| EP | 0 854 342 A2 | 7/1998 | |
| EP | 0 859 209 | 8/1998 | |
| FR | 2 261 819 | 9/1975 | |
| FR | 2716529 A1 * | 8/1995 | F28F/1/02 |
| FR | 2 757 615 | 6/1998 | |
| SE | 303 120 | 8/1968 | |
| WO | 88/08508 | 11/1988 | |
| WO | 93/00563 | 1/1993 | |

* cited by examiner

*Primary Examiner*—Allen Flanigan
(74) *Attorney, Agent, or Firm*—Foley & Lardner

(57) ABSTRACT

The height of a bead opposing a joint where side edges of a plate are to be joined is set to be smaller than the height of a bead which does not oppose the joint by the thickness of the plate. Further, lands are provided between the beads and protrude from either the tube surface or the tube surface toward the inside of the main tube unit, and flow gaps are formed through which the heat-exchange medium flows over the lands.

20 Claims, 12 Drawing Sheets

FLAT TUBES FOR USE WITH HEAT EXCHANGER AND MANUFACTURING METHOD THEREOF

This application is a continuation of application Ser. No. 09/487,893, filed Jan. 19, 2000, now U.S. Pat. No. 6,267, 177.

BACKGROUND OF THE INVENTION

1. Field of the Invention

The present invention relates to a flat heat-exchange tube for use with a condenser, an evaporator, a heater core, and a radiator each of which is employed in an automotive air-conditioner for effecting a refrigerating operation, as well as to a method of manufacturing the flat heat-exchange tube. More specifically, the present invention relates to a heat-exchange tube in which a plurality of protuberances are formed so as to protrude inwardly.

The present application is based on Japanese Patent Applications No. Hei. 11-11113 and 11-22771, which are incorporated herein by reference.

2. Description of the Related Art

As shown in FIGS. 15 and 16, a known flat heat-exchange tube is formed from a plate 1 in which a plurality of beads 1A are formed so as to protrude to one side of the plate and a plate 2 in which a plurality of beads 2A are formed so as to protrude to one side of the plate. Specifically, the flat heat-exchange tube is formed by assembling the plates 1 and 2 such that the tops of the beads 1A and the tops of the beads 2A are connected together by means of brazing.

Another type of known flat heat-exchange tube is shown in FIG. 17. As shown in the drawing, the heat-exchange tube is formed by folding a single plate 4 into a flat tube, bonding opposite ends 4A, 4A of the plate 4, and inserting an inner fin 5 into the internal space of the flat tube.

FIG. 18 shows a still another type of a known flat heat-exchange tube. A flat heat-exchange tube A is described in Japanese Patent Publication No. Hei. 7-19774. The flat heat-exchange tube A comprises a flat main tube unit B through which a heat-exchange medium flows, and a plurality of cylindrical beads D which connect tube surfaces C, C, both mutually opposing within the main tube unit B, and cause turbulence in the flow of the heat-exchange medium. Reinforcement protuberances E are formed between a U-shaped bend portion B1 of the heat-exchange tube A and the main tube unit B, to thereby connect the tube surfaces C, C to the bend B1 in the longitudinal direction of the main tube unit B and to reinforce the bend B1.

In the flat tube A, a heat-exchange medium flowing through the main tube unit B is circulated while the plurality of beads D cause turbulence in the laminar flow of the heat-exchange medium, thereby improving a heat exchange efficiency.

Aforementioned known flat heat-exchange tubes have encountered the following problems.

In the flat heat-exchange tube shown in FIG. 15, when the plates 1 and 2 are brought into contact with each other, joints 3 which protrude from either side of the plates 1 and 2 in the widthwise direction thereof become deformed, as shown in FIG. 16, thus causing a brazing failure. Further, since the joints 3 protrude from the plates 1 and 2 in the widthwise direction thereof, the widthwise length of the heat-exchange tube becomes longer. The diameter of an unillustrated header pipe to which the flat heat-exchange tube is to be mounted becomes larger correspondingly.

In the flat heat-exchange tube shown in FIG. 17, the pressure applied to the joints of the plate 4 is made insufficient when the inner fin 5 is inserted into the internal space and becomes displaced, thus becoming more likely to cause a brazing failure.

In the flat heat-exchange tube A shown in FIG. 18, the plurality of beads D cause substantially two-dimensional turbulence in the laminar flow of the heat-exchange medium, and hence the thus-generated turbulence has a little effect of causing turbulence in a thermal boundary layer of heat-exchange medium developing in the vicinity of the tube surfaces C, C, thus limiting an improvement in heat exchange efficiency.

SUMMARY OF THE INVENTION

The present invention is aimed at providing a flat heat-exchange tube which can firmly fix joints and has a narrow width.

The present invention is also aimed at providing a flat heat-exchange tube which can improve heat exchange efficiency than does a known flat heat-exchange tube.

According to a first aspect of the present invention, there is provided a flat heat-exchange tube comprising: a plate of which opposite side edges are folded into a flat tube shape and joined together so as to constitute a flow space for a heat-exchange medium; and a plurality of beads being formed so as to protrude inwardly from one of or both of mutually-opposed flat surface portions of the plate, tops of the beads being joined to corresponding areas on the flat surface portion, wherein a first side edge of the opposite side edges is located on an inner side of a second side edge of the opposite side edges, and joined to the top of the bead located opposite the first side edge.

A height of the bead opposing. the first side edge may be set to be lower than a height of the bead located so as not to oppose the first side edge.

Preferably, the height of the bead opposing the first side edge is set to be lower than the height of the bead located so as not to oppose the first side edge by a thickness of the plate.

The beads can be formed in a plurality of rows in a longitudinal direction of the flat surface portion. An area where the opposite side edges are joined together may be located opposite over a plurality of rows of the beads.

According to a first aspect of the present invention, there is provided a method of manufacturing a flat heat-exchange tube comprising steps of: forming a plurality of beads in one surface portion of a plate so as to protrude from the surface portion; folding the plate into a flat tube shape such that the beads protrude to an inside of the flat tube; bringing side edges of the plate into contact with each other; bringing a joint where the side edges are contacted into contact with a top of the beads; and fixing the joint and a contacted portion of the beads.

The joint may be formed so as to be located within one of the two mutually-opposed flat surface portions of the plate.

The above manufacturing method preferably further comprises a step of forming a stepped portion having a height corresponding to a thickness of the plate on one side edge for fittingly receiving the other side edge at the step of bringing side edges, to thereby make an exterior peripheral surface of the plate including the joint plane, wherein a height of the bead opposing the joint is set to be lower than a height of the bead located so as not to oppose the joint by an amount smaller than the thickness of the plate prior to the fixing step.

According to a third aspect of the present invention, there is provided a flat heat-exchange tube comprising: a flat main tube body through which a heat-exchange medium flows; a plurality of beads for connecting tube surfaces both mutually opposing within the main tube body, to thereby cause turbulence in a flow of the heat-exchange medium within the main tube body; lands being provided between the beads and protruding from al least one tube surface toward an inside of the main tube body; and flow gaps through which the heat-exchange medium flows over the lands.

Preferably, the lands cross-link the beads.

Preferably, beads are intermittently arranged in the main tube body with a plurality of rows in a longitudinal direction of the main tube unit, and the beads of a certain row and the beads of another adjacent row are arranged in a staggered configuration, and the lands are formed between all the beads of the adjacent rows such that a bead of the certain row is linked to the beads of the adjacent rows located in upstream positions with respect to a flow of the heat-exchange medium as well as to the beads of the adjacent rows located in downstream positions with respect to the flow of the heat-exchange medium.

On the other hand, the lands can formed between all the beads of adjacent rows such that a bead of a certain row is linked to one of the beads of the adjacent rows located in upstream positions with respect to a flow of the heat-exchange medium as well as to one of the beads of the adjacent rows located in downstream positions with respect to the flow of the heat exchange medium, to thereby linearly link the beads.

The beads can be arranged at uniform intervals in the longitudinal direction of the main tube body, and the beads of a certain row and the beads of another adjacent row can be arranged in a staggered configuration.

The lands may be formed so as to have a circular-arc cross section.

In the present invention, the height of a bead located opposite one side edge of a plate is set to be lower than the height of another bead located so as not to oppose the side edge. Therefore, a joint where both side edges of the plate meet and are joined can be prevent ed from raising outwardly from the exterior side surface of the plate. Further, the joint of the plate is formed in a flat surface portion of the plate opposing the beads, thereby preventing an undesired increase in the width of a flat heat-exchange tube.

The joint where the side edges of the plate meet and are joined can be made in flush with the exterior side surface of the plate, thus preventing the joint from raising from the exterior side surf ace of the flat heat-exchange tube. Further, beads located so as not to oppose the joint can be joined to corresponding areas on the flat surface portion of the plate unfailingly.

The joint where the side edges of the plate meet and are joined can be connected to the tops of the row of beads formed in the flat surface portion(s) in the longitudinal direction thereof, thus forming a firmly-connected joint over the plate in the longitudinal direction thereof and ensuring a joint strength.

The joint where the side edges of the plate meet and are joined are joined to a plurality of rows of beads, thus increasing the bonding strength of the joints to a much greater extent.

The joint where the side edges of the plate meet and are joined and the joint and the tops of the beads can be brought into contact with each other and fixed together by a single operation. The joint and the tops of the beads can be brought into contact with each other by pressing the joint formed between the side edges of the plate, thus facilitating manufacture of a flat heat-exchange tube.

The joint where the side edges of the plate meet and are joined is placed within the flat surface portion of the plate, thus preventing an increase in the width of the flat heat-exchange tube. Accordingly, there can be prevented an increase in the diameter of a pipe to which the flat heat-exchange pipe is to be mounted.

A step having a height corresponding to the thickness of the plate is formed in one of the side edges of the joint, thus preventing the joint from raising outwardly, which would otherwise be caused when the side edges are joined. The height of beads located opposite the joint is set beforehand to be lower than the height of beads located so as not to oppose the joint, by only the height of the plate. Accordingly, when the plate is folded, the joint where the side edges of the plate meet can be situated on and brought into pressing contact with the tops of the beads, thus forming contacts unfailingly. Further, the tops of the beads located so as not oppose the joint can also be brought into contact with the interior surface of the plate by means of the pressing force, thus achieving formation of contacts and firm brazing unfailingly.

Further, in the present invention, a heat-exchange medium flows over lands while the laminar flow of the heat-exchange medium is made turbulent by a plurality of beads. The heat-exchange medium flowing over the lands flows down from their tops toward a tube surface, thus causing turbulence in a thermal boundary layer of heat-exchange medium developing in the vicinity of the tube surface. The heat-exchange tube of the present invention can make the thermal boundary layer of the heat-exchange medium thinner than does the known flat heat-exchange tube having only a plurality of beads, thus enabling a further improvement in the heat exchange efficiency.

In the present invention, since the beads are cross-linked by the lands, the heat-exchange medium flowing between the beads can fall down from the tops of the lands toward the tube surface unfailingly. Accordingly, the thermal boundary layer of the heat-exchange medium developing in the vicinity of the tube surface can be made turbulent unfailingly.

In the present invention, all the beads are linked by the lands so as to intersect diagonally with respect to the longitudinal direction of a main tube unit. A plurality of substantially-rectangular regions, each having four sides which are diagonal with respect to the longitudinal direction of the main tube unit, are formed in either one of the tube surfaces. In each of the rectangular regions, the thermally boundary layer can be made turbulent. Accordingly, the heat-exchange tube of the present invention can improve a heat exchange efficiency to a greater extent.

In the present invention, all the beads are linked by the lands so as to intersect diagonally with respect to the longitudinal direction of the main tube unit. Consequently, in at least one of the tube surfaces there can be formed alternately land regions—in which the beads are linked by the lands so as to extend diagonally with respect to the longitudinal direction of the main tube unit—and flow regions which extend along the land regions and do not have any lands.

The heat-exchange medium that has flowed over the lands provided in the land regions can cause turbulence in the thermal boundary layer of the heat-exchange medium. Further, the flow regions enable smooth flow of the heat-exchange medium, thus achieving both an improvement in heat exchange efficiency and a reduction in flow resistance.

In the present invention, the beads are arranged at uniform intervals in the longitudinal direction of the main tube unit. The beads of the adjacent rows are arranged in a staggered configuration, thus increasing the distribution density of the beads. Consequently, there can be achieved a further increase in heat exchange efficiency and an improvement in compressive strength of the main tube unit.

In the present invention, the land formed has a circular-arc cross section, thus enabling a decrease in the flow resistance which the heat-exchange medium encounters when flowing over the top of the land. Accordingly, the heat-exchange tube of the present invention can diminish flow resistance.

Features and advantages of the invention will be evident from the following detailed description of the preferred embodiments described in conjunction with the attached drawings.

DETAILED DESCRIPTION OF THE PREFERRED EMBODIMENTS

A flat heat-exchange tube according to the present invention will be described in detail hereinbelow by reference to embodiments illustrated in the accompanying drawings.

Figure 1:
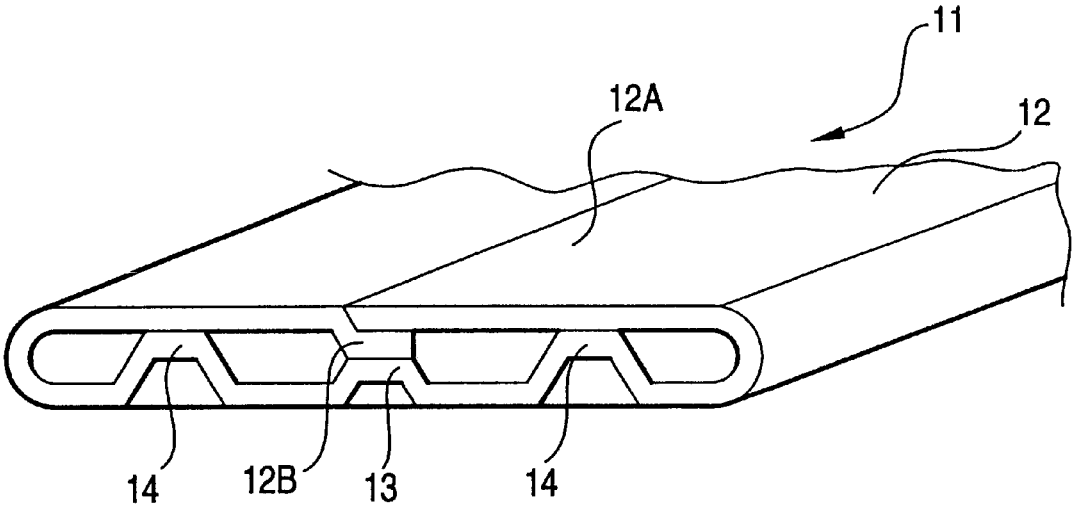
FIG. 1 is a perspective view showing the principal section of a flat heat-exchange tube according to a first embodiment of the invention.

FIGS. 1 through 6 show a flat heat-exchange tube according to a first embodiment of the present invention. FIG. 1 is a perspective view showing the principal section of a flat heat-exchange tube 11 of a condenser which is employed as an automotive heat exchanger for effecting a refrigerating operation.

As shown in FIG. 1, side edges 12A and 12B of a single rectangular plate 12 are folded so as to overlap at the center of the plate 12, thus forming the flat heat-exchange tube 11. Channels for a heat-exchange medium serving as a coolant are formed within the flat heat-exchange tube 11. A plate joint where the side edges 12A and 12B overlap is jointed to the top surface of a bead 13 protruding from a portion of the plate 12 opposing the plate joint (i.e., the underside portion of the plate 12). The plate joint between the side edges 12A and 12B, the side edge 12B located inside of the plate joint, and the top surface of the bead 13 are connected by means of brazing.

The beads 13 are intermittently and protruding formed in rows in the surface of the plate 12 along the longitudinal direction (i.e., the direction in parallel with the side edges 12A and 12B) of the flat heat-exchange tube 11. The plate joint is set to be located on each of the rows of beads 13. Beads 14 are intermittently formed in rows in the area of the underside portion of the plate 12, which area does not face the plate joint, in the longitudinal direction thereof. The row of bead 14 is higher than the row of bead 13. In the present embodiment, two rows of beads 14 are intermittently formed in the plate 12 in the longitudinal direction thereof. The beads 13 and 14 are formed by means of dimpling, and the beads 14 are fixed to the portions of the plate 12 opposing the beads 14 by means of brazing.

Figure 2:
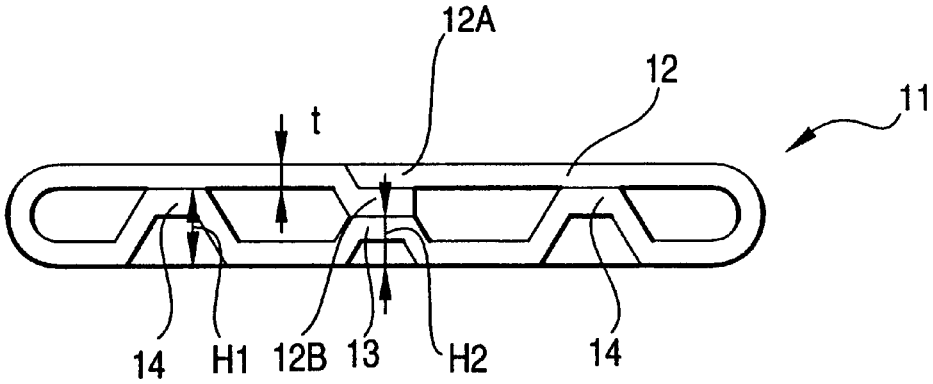
FIG. 2 is a cross-sectional view showing the principal section of the flat heat-exchange tube of the first embodiment.

As shown in FIG. 2, The height H1 of the bead 13 formed in the flat heat-exchange tube 11 of the present embodiment is larger than the height H2 of the bead 14 by the thickness "t" of the plate 12. A step is formed in the side edge 12B which will constitute a plate joint, to a height corresponding to the thickness "t" of the plate 12. The side edge 12A is fitted into the step, thus rendering the exterior surface of the plate joint plane. Each of the beads 13 and 14 is circular when viewed from the above and is trapezoidal when viewed in cross section. The beads 13 and 14 complicate and elongate the coolant flow channel and contribute to an increase in the surface area and rigidity of the flat heat-exchange tube 11. Although not shown in the drawings, an inlet port for permitting inflow of a coolant is formed in one longitudinal end of the flat heat-exchange tube 11, and an outlet port for permitting outflow of a coolant is formed in the other longitudinal end of the same.

Figure 3:
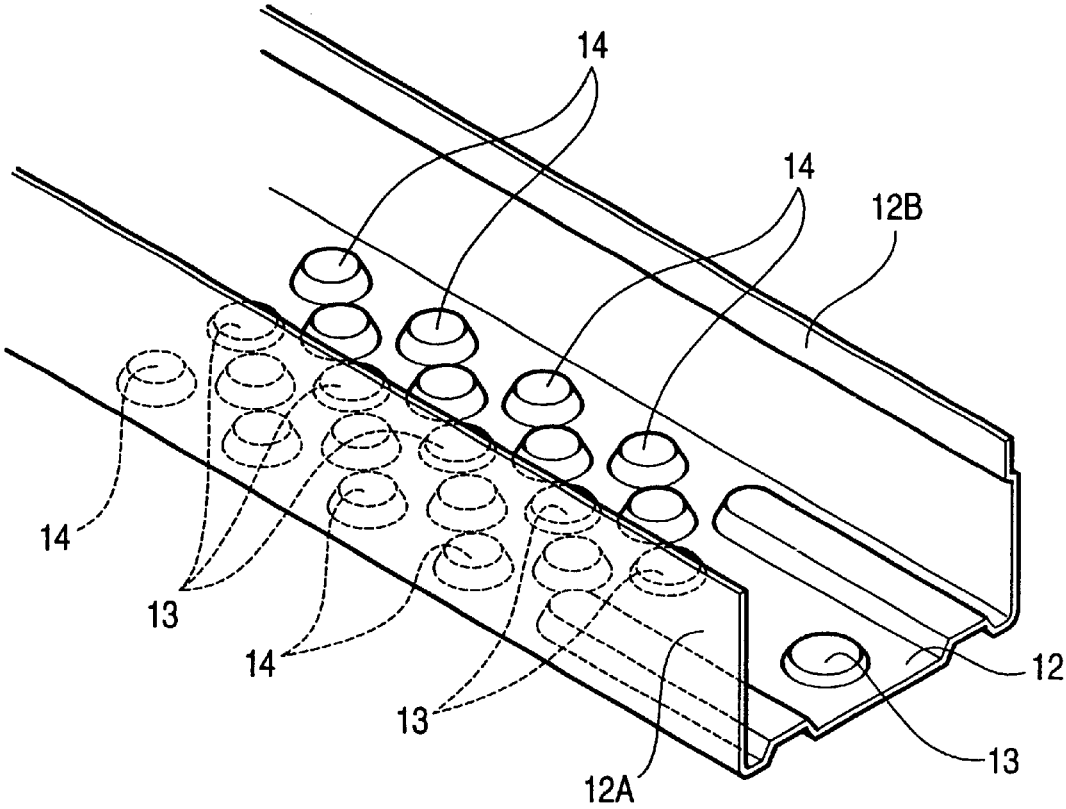
FIG. 3 is a perspective view of the principal section of a plate constituting the flat heat-exchange tube of the first embodiment.

A method of manufacturing the flat heat-exchange tube 11 of the present embodiment will now be described by reference to FIGS. 3 through 6. In the present embodiment, the plate 12, which has already been machined as shown in FIG. 3, is folded and subjected to brazing. As shown in the drawing, in the present embodiment, the beads 13 and 14 are formed in an intermediate area of the plate 12 which has a predetermined width and extends in the longitudinal direction of the plate 12. The side edge on either side of the intermediate area of the plate 12 is folded. A step for fittingly receive the side edge 12A when the side edges 12A and 12B are folded is formed along the edge of the side edge 12A. The beads 13 are intermittently formed in a row along the longitudinal center of the plate 12, and the beads 14 are formed in a predetermined layout on either side of the row of beads 13. The number of rows of beads 13 and the number of rows of beads 14 may be changed, as required, according to the size of the flat heat-exchange tube 11.

Figure 4:
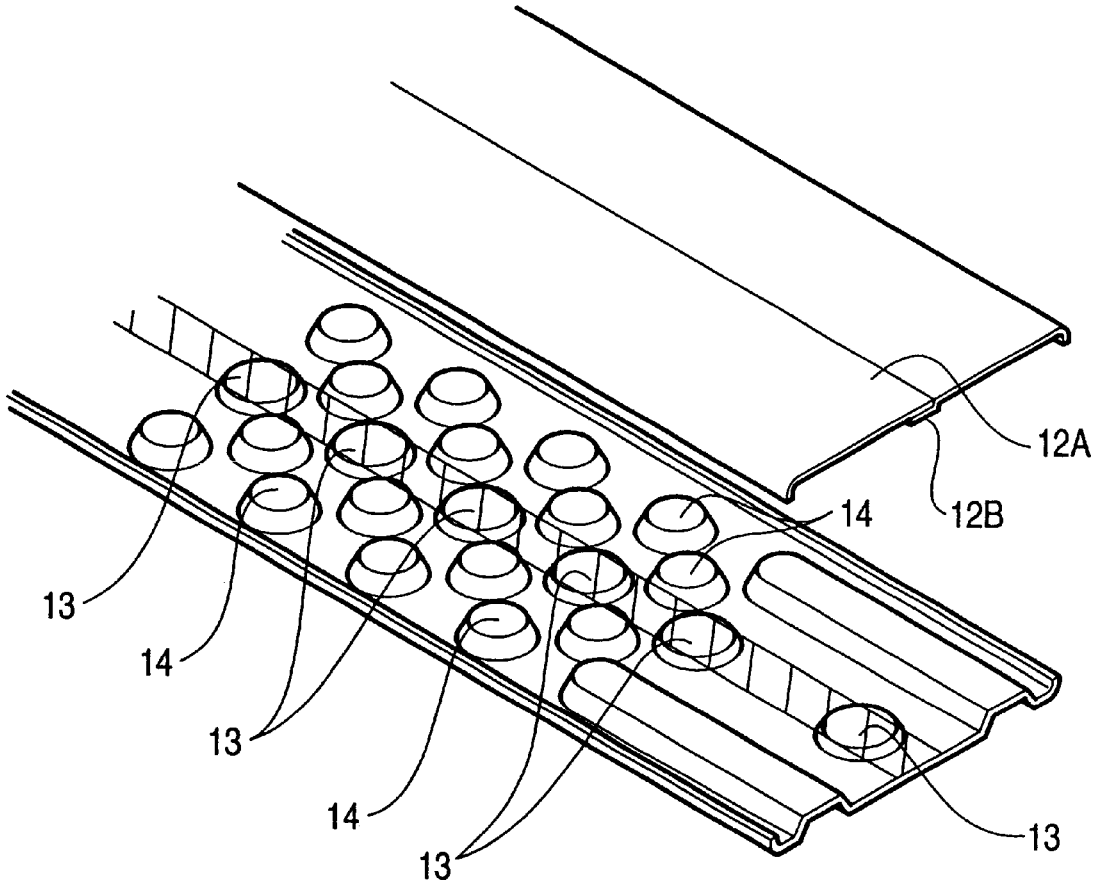
FIG. 4 is an exploded perspective and descriptive view showing the flat heat-exchange tube of the first embodiment.

The side edges 12A and 12B of the plate 12 are folded such that the side edge 12A is laid on the side edge 12B, as shown in FIG. 4. FIG. 4 is an exploded perspective and descriptive view showing the flat heat-exchange tube 11 when the tube 11 is cut and exploded so as to make the underside portion of the plate 12 visible. In FIG. 4, the shaded area denotes the area where a plate joint is to be formed; that is, a position on the beads 13.

Figure 5:
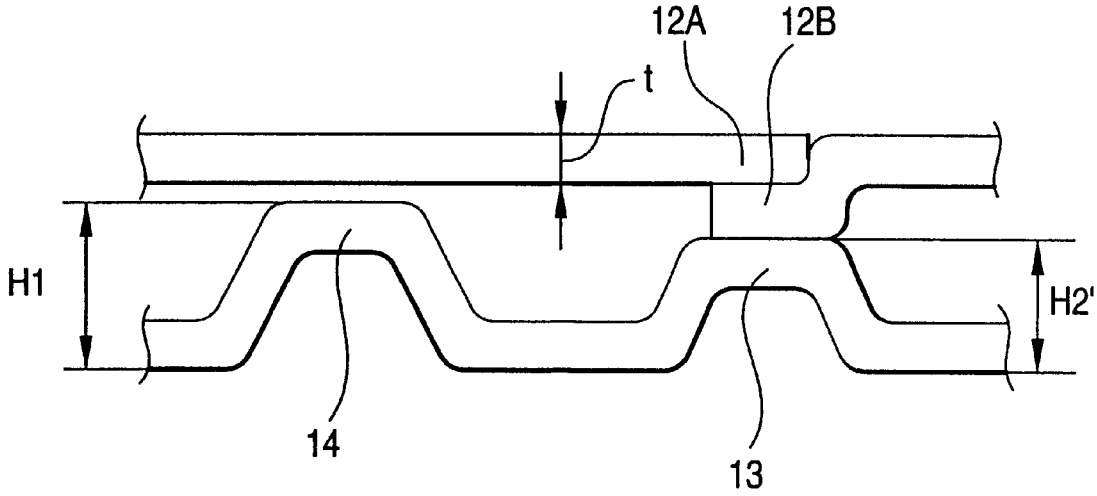
FIG. 5 is a cross-sectional descriptive view showing the principal section of the flat heat-exchange tube of the first embodiment.

Next will be described the height of the beads 13 and the height of the beads 14, which are formed in the plate 12 beforehand. As shown in FIG. 5, the height H2' of the bead 13 is set beforehand so as to be lower than the height of H1 of the bead 14 by an amount smaller than the thickness "t" of the plate 12. Thus, the height H2' of the bead 13 is set slightly higher than a height which is obtained by subtracting the thickness "t" from the height of H1 of the bead 14 (H2'+t>H1). FIG. 5 shows the plate joint (where the side edges 12A and 12B overlap) is in contact with the top surface of the bead 13. At this time, the top surface of the bead 14 is spaced apart from a corresponding portion of the interior surface of the plate 12.

Figure 6:
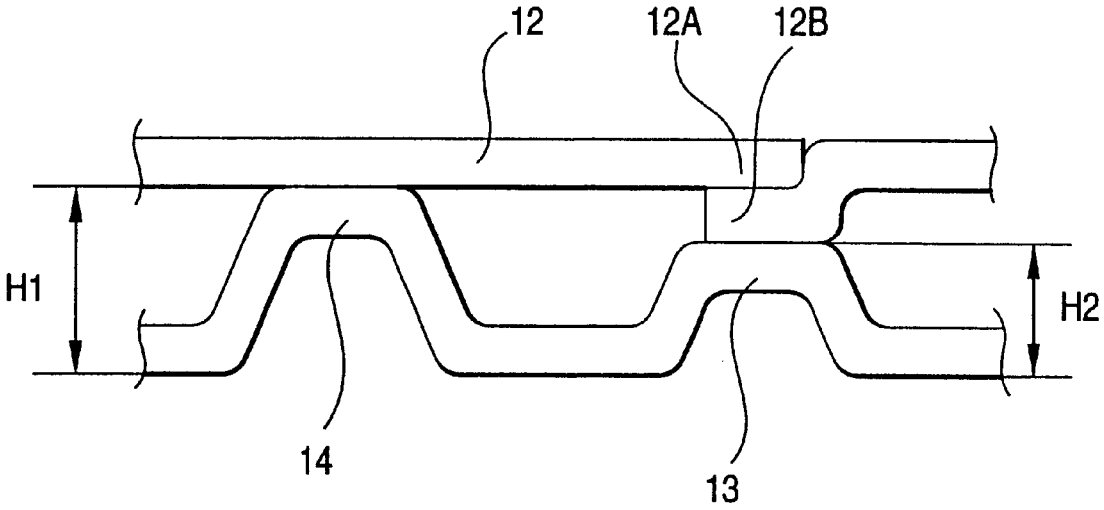
FIG. 6 is a cross-sectional descriptive view showing the principal section of the flat heat-exchange tube of the first embodiment.

The plate joint is forcefully pressed against the top surface of the bead 13 by means of predetermined force, thereby bringing the side edge 12A into contact with the side edge 12B and bringing the side edge 12B into contact with the top surface of the bead 13 unfailingly. At this time, the height of the bead 13 is reduced to H2 by means of pressing force. As shown in FIG. 6, the interior surface of the plate 12 is also brought into contact with the top surfaces of the beads 14 by means of the pressing force. While the side edges 12A and 12B, the side edge 12B and the beads 13, the beads 14 and the interior surface of the plate 12 are remaining in contact with each other respectively, these portions are fixed by means of brazing, thereby forming the flat heat-exchange tube 11 of the present embodiment.

In the present embodiment, formation of firm joints and reliable brazing can be achieved by setting the height of the beads 13 and the height of the beads 14 in the manner as mentioned previously. The beads 13 and 14, which have been formed in a layout such as that mentioned above, cause turbulence in the flow of a coolant circulating between the beads 13 and 14, thus improving heat exchange efficiency.

Figure 7:
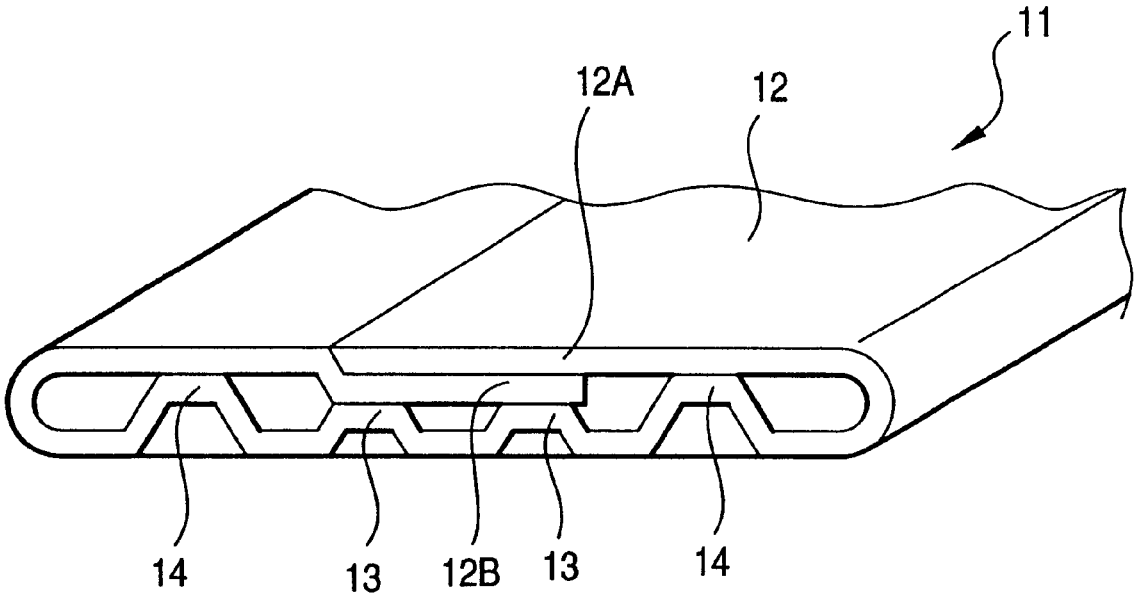
FIG. 7 is a cross-sectional descriptive view showing the principal section of a flat heat-exchange tube according to a second embodiment of the present invention.

The plate joint may be formed so as to extend across two rows of beads 13 according to a second embodiment as shown in FIG. 7. In this case, the pressing force to be applied for bringing the side edges into contact with each other can be made to a greater extent. In the above embodiments, the beads are formed to protrude from one flat portion of the plate (i.e., the underside portion of the plate). Needless to say, beads may be formed so as to protrude from both flat portions of the plate (i.e., both the upper portion and the lower portion of the plate).

Figure 8:
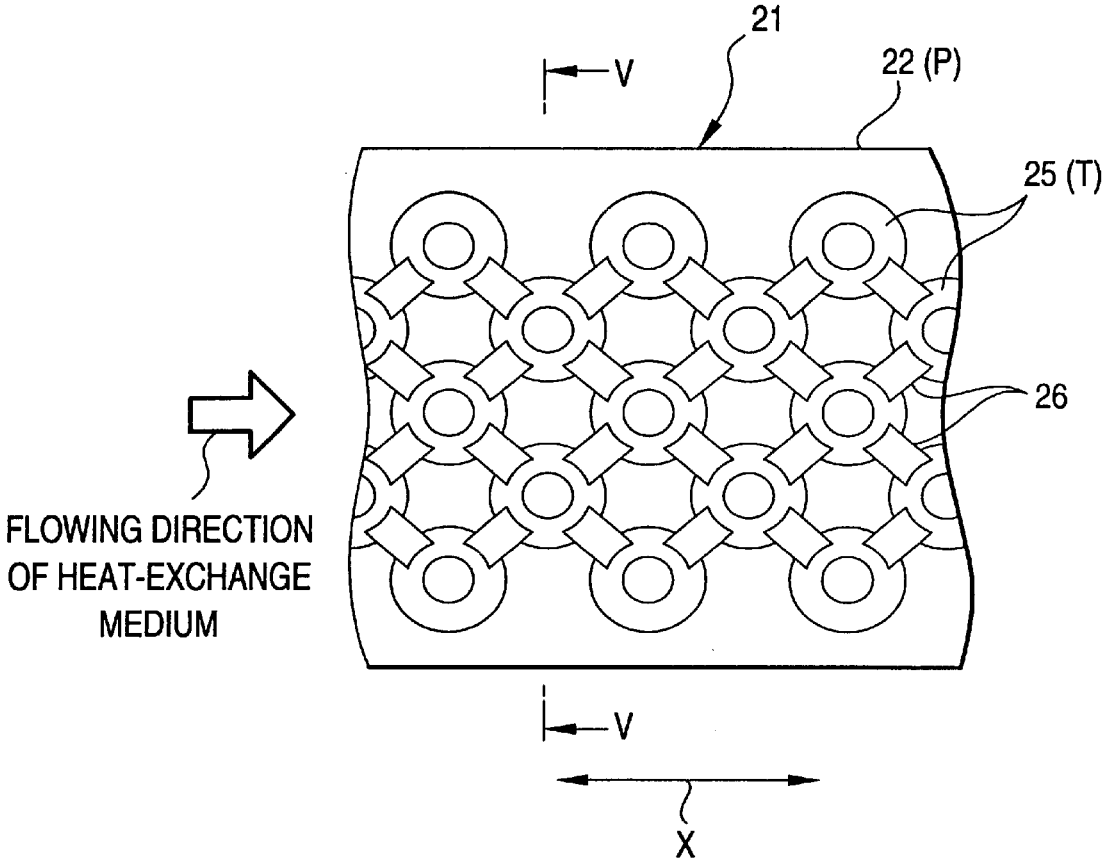
FIG. 8 is a plan view showing a heat-exchange tube according to a third embodiment of the present invention.
Figure 9:
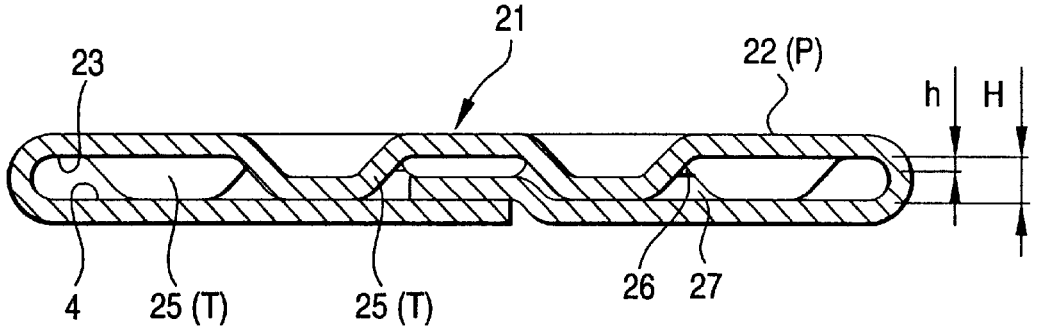
FIG. 9 is a cross-sectional view of the heat-exchange tube taken along line V—V shown in FIG. 8.

FIG. 8 is a plan view showing a third embodiment according to the present invention. FIG. 9 is a cross-sectional view taken along line V—V shown in FIG. 8. As shown in FIGS. 8 and 9, the heat exchange flat tube 1 comprises a flat main tube unit 22 through which a heat-exchange medium flows, and a plurality of beads 25 which connect tube surfaces 23, 24, both mutually opposing within the main tube unit 22, and cause turbulence in the flow of a heat-exchange medium within the main tube unit 22.

The bead 25 has an oval and cylindrical shape, whose major axis extends in the longitudinal direction X of the main tube unit 22. A land 26 and a flow gap 27 are formed between the adjacent beads 25. The land 26 protrudes from the tube surface 23 and extends to the inside of the main tube unit 22 together with the bead 25, thereby cross-linking the beads 25. The heat-exchange medium flows over the lands 26 through the flow gaps 27.

An unillustrated inlet port which permits inflow of a heat-exchange medium into the main tube unit 22 is formed in one end of the main tube unit 22 in its longitudinal direction X. Further, an outlet port which permits outflow of the heat-exchange medium to the outside of the main tube unit 22 is formed in the other end of the main tube unit 22 in its longitudinal direction X.

The flat tube 21 is formed by folding the opposite sides of a single rectangular plate P, which are located in the width-wise direction thereof, and brazing the edges of the thus-folded sides of the plate P at the center thereof.

A plurality of protuberances T which will be formed into the beads 25 are formed, beforehand and by means of dimpling, at predetermined positions in the surface of the plate P where the tube surfaces 23 and 24 will be formed after processing. The top surfaces of the protuberances T is brazed to the tube surface 24 when the plate P is folded, thus constituting the beads 25. Further, a plurality of lands 26 are formed, beforehand and by means of dimpling, between the adjacent beads 25 in the surface of the plate P where the tube surfaces 23 and 24 will be formed after processing.

As shown in FIG. 8, in the flat tube 21 there are formed a plurality of equally-spaced rows of beads 25 in the longitudinal direction X of the main tube unit 22. The beads 25 of the adjacent rows are arranged in a staggered configuration.

All the beads 25 are linked by the respective lands 26 such that a bead 25 of the certain row is linked to the beads 25 of adjacent rows located in upstream positions with respect to the direction of flow of the heat-exchange medium as well as to the beads 25 of the adjacent rows located in downstream positions with respect to the direction of flow of the heat-exchange medium.

In the flat tube 21, the beads 25 are linked by the lands 26 so as to diagonally intersect with respect to the longitudinal direction X of the main tube unit 22. In FIG. 8, reference symbol H designates the distance between the tube surfaces 23 and 24, and reference symbol "h" designates the height of the land 26 protruding from the tube surface 23.

Figure 10:
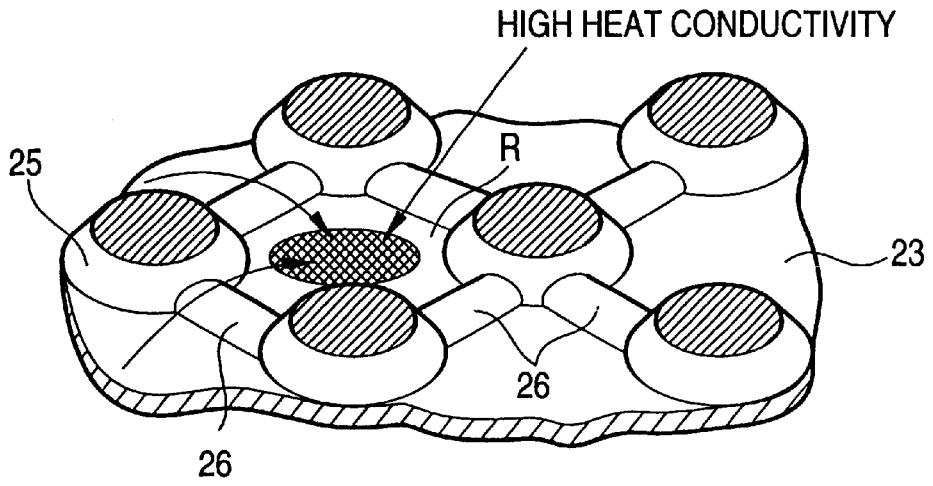
FIG. 10 is a perspective view showing the principal section of the heat-exchange tube shown in FIG. 8.

FIG. 10 is a perspective view showing the principal section of the flat heat-exchange tube shown in FIG. 8. As shown in FIG. 10, in the flat tube 21, the heat-exchange medium flows over the lands 26 while the laminar flow of the heat-exchange medium is made turbulent by the plurality of beads 25.

Figure 18:
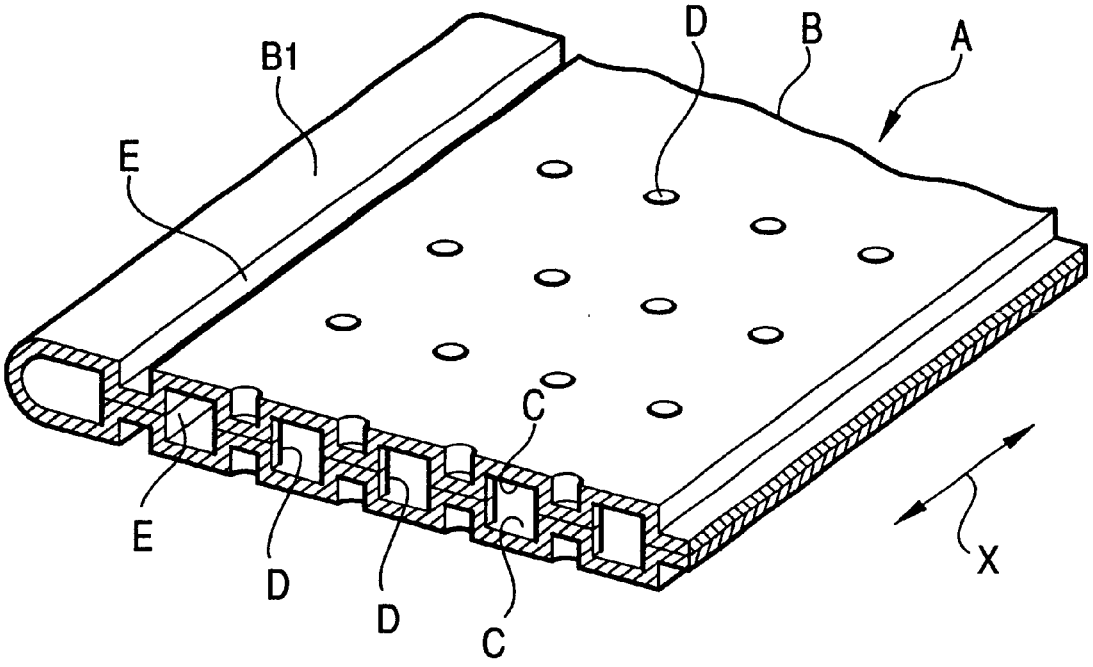
FIG. 18 is a perspective view showing a still another example of a known heat-exchange tube.

The heat-exchange medium flowing over the lands 26 flows down from their tops toward the tube surface 23, thus causing turbulence in the thermal boundary layer of the heat-exchange medium developing in the vicinity of the tube surface 23. Therefore, the heat-exchange tube of the present invention can make the thermal boundary layer of the heat-exchange medium thinner than does the known flat heat-exchange tube which has only the plurality of beads D and is shown in FIG. 18, thus enabling a further improvement in the heat exchange efficiency.

Since in the flat tube 1 all the beads 25 are cross-linked by the lands 26, the heat-exchange medium flowing between the beads 25 can fall down from the tops of the lands 26 toward the tube surface 23 unfailingly. Accordingly, the thermal boundary layer of the heat-exchange medium developing in the vicinity of the tube surface 23 can be made turbulent unfailingly.

In the flat tube 21, the beads 25 are linked so as to intersect diagonally by the lands 26 with respect to the longitudinal direction X of the main tube unit 22. A plurality of substantially-rhomboid regions R, each having four sides which are diagonal with respect to the longitudinal direction X of the main tube unit 22, are formed in the tube surface 23. In each of the rhomboid regions R, the thermally boundary layer can be made turbulent. Accordingly, the heat-exchange tube of the present invention can unfailingly improve a heat exchange efficiency than does the known heat-exchange tube shown in FIG. 18.

In the flat tube 21, the beads 25 are arranged at uniform intervals in the longitudinal direction X of the main tube unit 22. The beads 25 of the adjacent rows are arranged in a staggered configuration, thus increasing the distribution density of the beads 25, enabling an increase heat exchange efficiency and an improvement in the compressive strength of the main tube unit 22.

As shown in FIG. 10, the land 26 formed in the flat tube 21 has a circular-arc cross section, thus enabling a decrease in the flow resistance which the heat-exchange medium encounters when flowing over the top of the land 26. Further, the bead 25 has an oval and cylindrical shape whose major axis extends in the longitudinal direction X of the main tube unit 22, thereby diminishing the flow resistance which the heat-exchange medium encounters when flowing along the outer circumferential surface of the bead 25. Accordingly, the heat-exchange tube of the present invention can diminish flow resistance.

The height "h" of the land 26 shown in FIG. 9 preferably assumes a value of 10 to 60% of the distance H between the tube surfaces 23 and 24. If the height "h" of the land 26 is under 10% of the distance H between the tube surfaces 23 and 24, the effect of causing turbulence in the thermal boundary layer of the heat-exchange medium, which would be caused when the heat-exchange medium flows from the top of the land 6 down toward the tube surface 23, becomes substantially lost. In contrast, if the height "h" of the land 26 exceeds 60% of the distance H between the tube surfaces 23 and 24, the flow resistance becomes excessively great.

Figure 11:
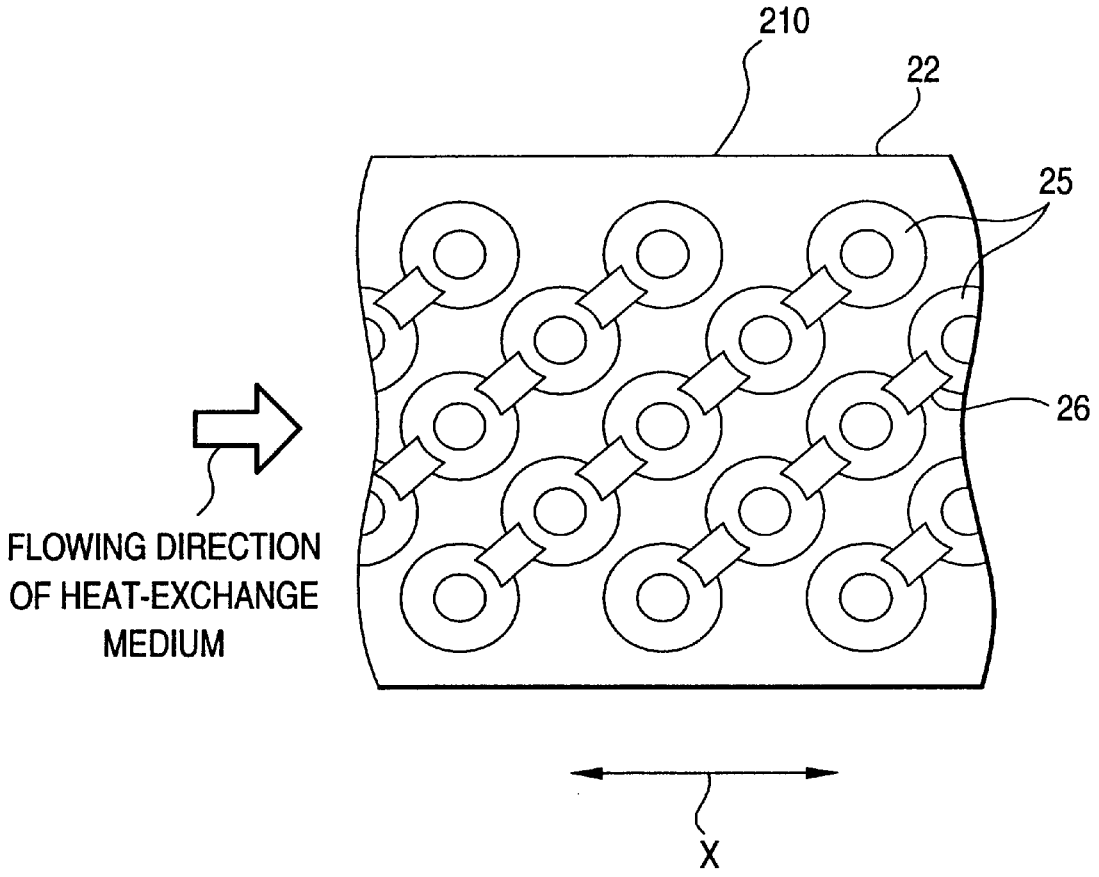
FIG. 11 is a plan view showing a heat-exchange tube according to a fourth embodiment of the present invention.
Figure 12:
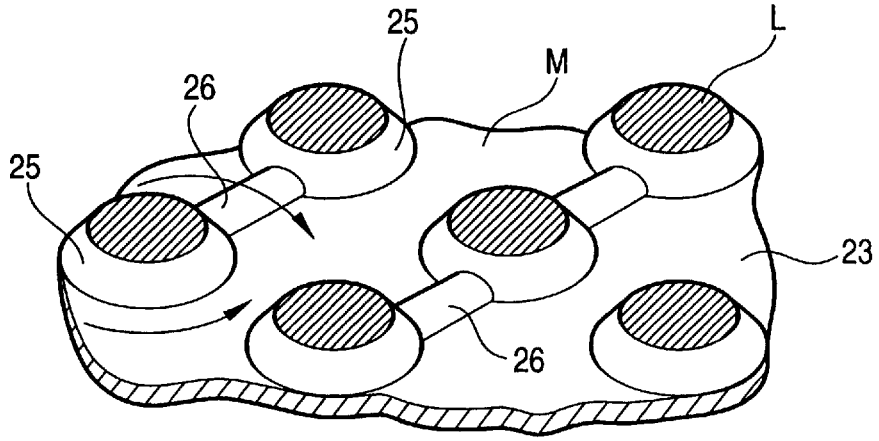
FIG. 12 is a perspective view showing the principal section of the heat-exchange tube shown in FIG. 11.

FIG. 11 is a plan view showing a fourth embodiment embodying the inventions described in the appended claims. FIG. 12 is a perspective view showing the principal section of a heat-exchange tube shown in FIG. 11. In the following description about the fourth embodiment, those constituent elements which are the same as those described in the third embodiment are assigned the same reference numerals, and repetition of their explanations is omitted.

As shown in FIGS. 11 and 12, in a flat tube 210, the beads 25 are connected by the land 26 such that one bead 25 of a certain row is connected to a bead 25 of the right-side adjacent row located in an upstream position relative to the one bead 25 when viewed in the flowing direction of the heat-exchange medium.

Further, the beads 25 are connected by the land 26 such that one bead 25 of a certain row is connected to a bead 25 of the left-side adjacent row located in a downstream position relative to the one bead 25 when viewed in the flowing direction of the heat-exchange medium.

In the flat tube 210, there can be formed alternately land regions L—in which the beads 25 are linked by the lands 26 so as to extend diagonally with respect to the longitudinal direction X of the main tube unit 22—and flow regions M which extend along the land regions L and do not have any lands 26. Consequently, the heat-exchange medium flows through the main tube unit 22 while flowing over the lands 26 in the land regions L as well as through the flow regions M not having the lands 26.

The heat-exchange medium that has flowed over the lands 26 can cause turbulence in the thermal boundary layer of the heat-exchange medium developing in the vicinity of the tube surface 23. Further, the heat-exchange medium can smoothly flow through the flow regions M, because the flow regions M do not have any lands 26, which would otherwise hinder smooth flow of the heat-exchange medium. Thus, the flat tube 210 of the present embodiment can achieve both an improvement in the heat exchange efficiency and a reduction in the flow resistance.

Figure 13:
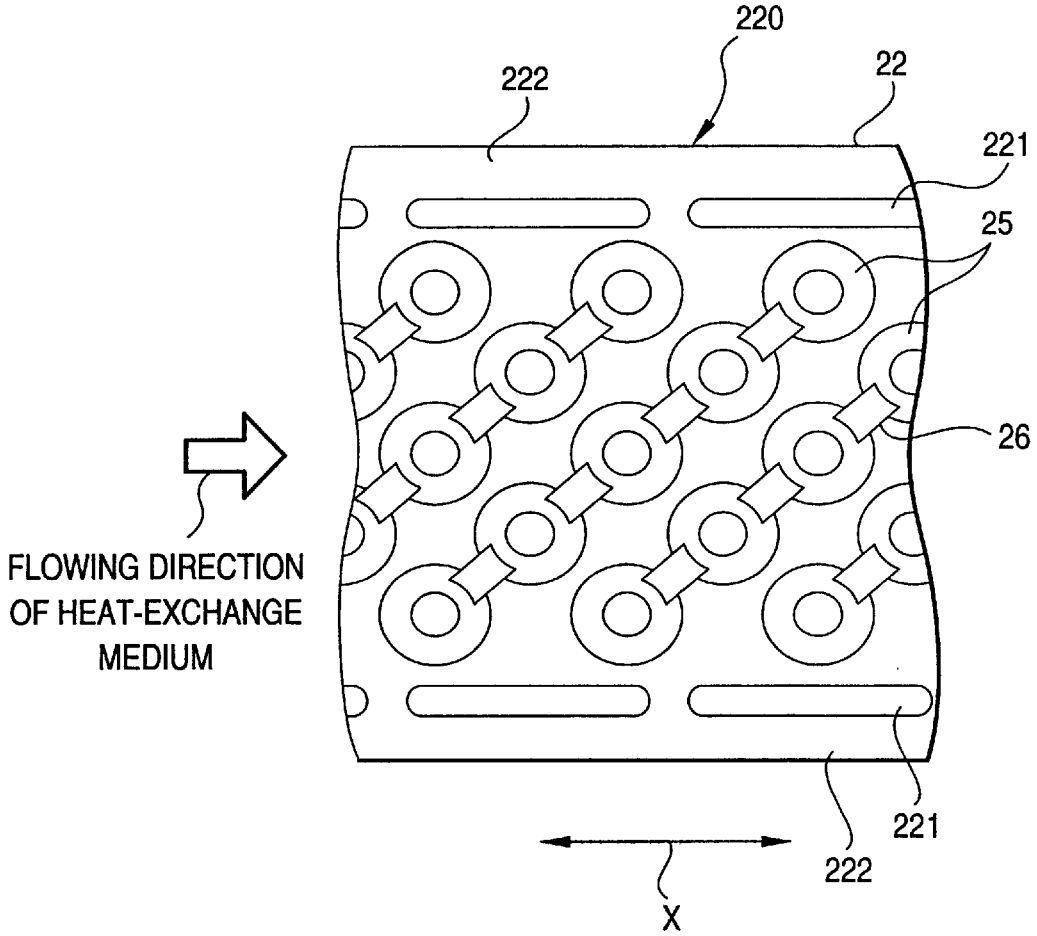
FIG. 13 is a plan view showing a heat-exchange tube according to a fifth embodiment of the present invention.

FIG. 13 is a plan view showing a fifth embodiment. As shown in FIG. 13, reinforcement protuberances 221 are formed along the opposite edges of a flat tube 220, which are located in the widthwise direction thereof, so as to protrude from the tube surface 23 and to be attached to the tube surface 24. The reinforcement protuberances 221 extend in the longitudinal direction X of the main tube unit 22.

In the flat tube 220, the reinforcement protuberances 221 can reinforce U-shaped bends 222 formed along the opposite edges of the main tube unit 22, the opposite edges being provided in the widthwise direction of the main tube unit 22. The reinforcement protuberances 221 may be provided in, for example, the center of the main tube unit 22 or in the flat tube 21 of the third embodiment.

In the flat tubes 21, 210, and 220, which have been described above, the bead 25 has an oval and cylindrical shape. The shape of the bead 25 is not limited to an oval and cylindrical shape. The bead 25 may assumes any one of the shapes comprising a circular and cylindrical shape, a prismatic shape, a two-step shape, a multi-step shape, and an elongated shape extending in the longitudinal direction X of the main tube unit 22. Alternatively, the beads 25 of any shapes may be used in combination. Here, the bead 25 desirably assumes a cylindrical shape, because the cylindrical shape diminishes the resistance which the heat-exchange medium encounters during flow.

The lands 26 formed on the surface of the respective flat tubes 21, 210, and 220 assume a circular-arc cross section. However, the cross-section of the land 26 is not limited to a circular-arc shape. For example, the land 26 may assume a dihedral shape or a polyhedral shape. However, since a circular-arc cross section diminishes the flow resistance, the land 6 desirably assumes a circular-arc cross section.

In the flat tubes 21, 210, and 220, the beads 25 and the lands 6 are formed so as to protrude from the tube surface 23. However, the beads 25 and the lands 26 may be formed so as to protrude from both the tube surfaces 23 and 24 or from the tube surface 24. Alternatively, the beads 5 may be fixedly sandwiched between the tube surfaces 23 and 24, and the lands 26 may be fixed on either the tube surface 23 or 24.

Figure 14:
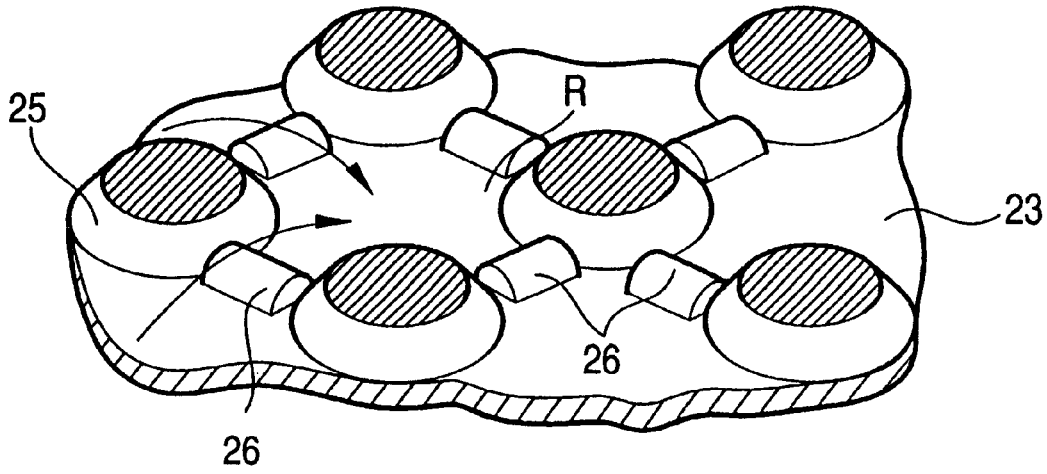
FIG. 14 is a perspective view showing a heat-exchange tube according to a sixth embodiment of the present invention.
Figure 15:
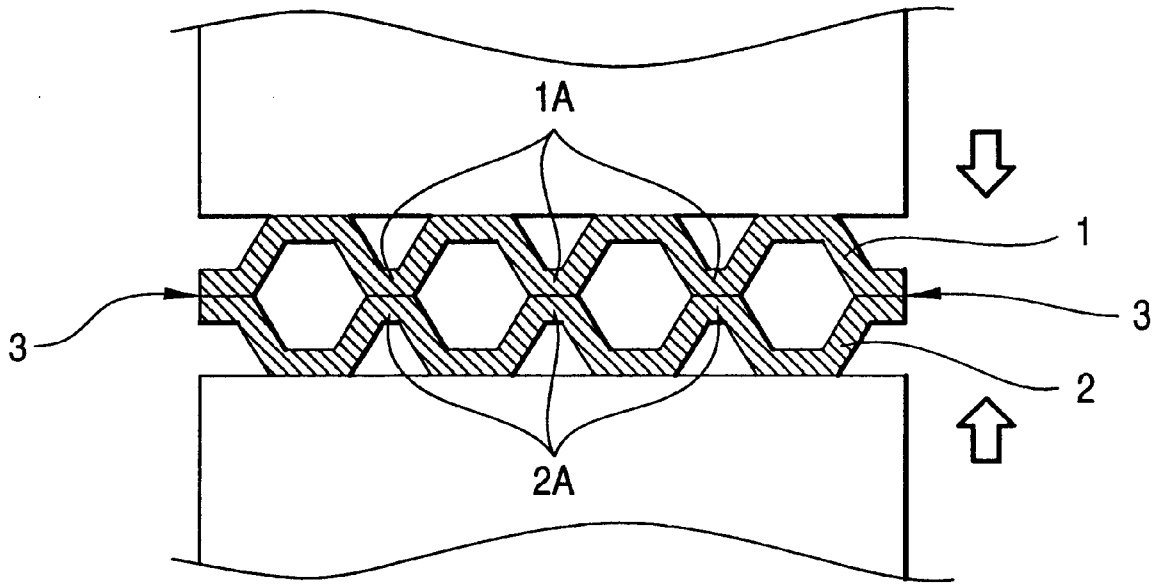
FIG. 15 is a descriptive view showing a process for manufacturing a known flat heat-exchange tube.
Figure 16:
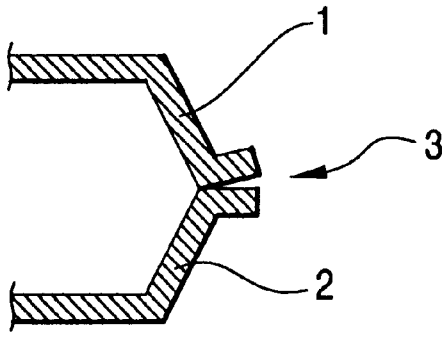
FIG. 16 is a cross-sectional view of the principal section of a known flat heat-exchange tube for describing a problem thereof.
Figure 17:
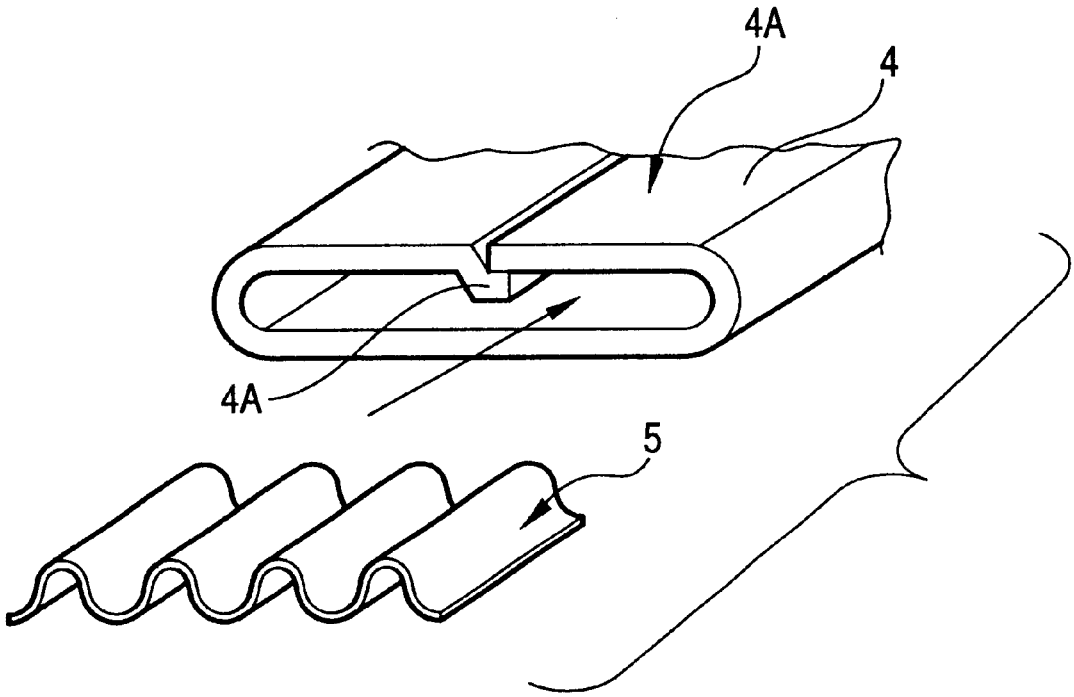
FIG. 17 is an exploded perspective view showing another example of a known flat heat-exchange tube.

In the flat tubes 21, 210, and 220, the lands 26 cross-link the adjacent beads 25. However, according to a sixth embodiment as shown in FIG. 14, the lands 26 may be formed between the adjacent beads 25 without cross-linking them. The beads 25 to be cross-linked by the lands 26 or the beads 25 having the lands 6 formed therebetween may not necessarily be adjacent to each other. In terms of an improvement in heat exchange efficiency, the beads 25 are desirably adjacent to each other.

Further, each of the flat tubes 21, 210, and 220 is formed by folding a single plate P. However, the flat tube may be formed by overlaying one plate on another plate, for example. It goes without saying that the flat tubes 21, 210, and 220 may be used for a tube of a known drawn-cup-type heat exchanger or a like heat exchanger. Hereupon, the drawn-cup-type heat exchanger means such a type of heat exchanger in which tanks are integrally formed with tubes.

Further, the present invention can be applied to a flat heat-exchange tube, such as an evaporator, a heater, or a radiator, as well as to a condenser employed in an automotive refrigeration system.

Although the present invention has been described by reference to the above embodiments, the present invention is not limited solely to the embodiments.

What is claimed is:

1. A flat heat-exchange tube comprising:

a plate having first and second side edges that are folded into a flat tube shape and joined together, to constitute a flow space for a heat-exchange medium and to form opposing flat surface portions; and a plurality of beads protruding inwardly from at least one of said opposing surface portions, tops of said beads being joined to said other opposing surface portion, wherein said first side edge is bent by an amount substantially equal to a thickness of said plate and located on an inner side of said second edge, and joined to the top of at least one of said beads located opposite said first side edge.

2. A flat heat-exchange tube according to claim 1, wherein said bead located opposite said first side edge has a first height and at least one of said beads not opposite said first side edge has a second height, said first height being less than said second height.

3. A flat heat-exchange tube according to claim 2, wherein said first height is less than said second height by an amount substantially equal to said thickness of said plate.

4. A flat heat-exchange tube according to claim 1, wherein said beads are formed in a plurality of rows in a longitudinal direction of said flat surface portion.

5. A flat heat-exchange tube according to claim 4, wherein an area where said first and second side edges are joined together is joined to the tops of a plurality of rows of said beads.

6. A flat heat-exchange tube according to claim 1, wherein said beads have a substantially cylindrical shaped surface.

7. A flat heat-exchange tube according to claim 1, further comprising at least one reinforcement protuberance inwardly protruding from one opposing surface portion and in contact with said other opposing surface portion.

8. A method of manufacturing a flat heat-exchange tube comprising the steps of:

providing a plate having surface portions and first and second side edges;

forming a plurality of beads in at least one of said surface portions of said plate, wherein said beads protrude from said surface portion;

folding said plate into a flat tube shape such that said beads protrude toward an inside of said flat tube;

bending said first side edge by an amount substantially equal to a thickness of said plate;

bringing said first and second side edges of said plate into contact with each other;

forming a joint wherein said first side edge contacts with an inner side of said second side edge; and contacting said joint with a top of at least one of said beads.

9. A method of manufacturing a flat heat-exchange tube according to claim 8, wherein said beads have a substantially cylindrical shaped surface.

10. A method of manufacturing a flat heat-exchange tube according to claim 8, wherein said joint forms a flat surface.

11. A method of manufacturing a flat heat-exchange tube according to claim 8, wherein said bending of said first side edge creates a stepped portion having a height substantially equal to a thickness of said plate, and wherein said bringing said first and second side edges into contact with one another comprises fittingly receiving said second side edge by said stepped portion.

12. A method of manufacturing a flat heat-exchange tube according to claim 8, wherein said bead opposite said joint has a first height and at least one of said beads not opposite said joint has a second height, said first height being less than said second height by an amount substantially equal to said thickness of said plate.

13. A method of manufacturing a flat heat-exchange tube according to claim 8, further comprising fixing said joint and said top of said bead in contact with said joint.

14. A flat heat-exchange tube comprising:

a plate having first and second side edges that are folded into a flat tube shape and joined together, to constitute a flow space for a heat-exchange medium and to form opposing flat surface portions; and a plurality of beads protruding inwardly from at least one of said opposing surface portions forming a plurality of rows in a longitudinal direction of said surface portion, tops of said beads being joined to said other opposing surface portion, wherein said first side edge is located on an inner side of said second edge to form a lap joint, said lap joint being joined to said tops of at least two rows of said beads.

15. A flat heat-exchange tube according to claim 14, wherein said rows of beads joined to said lap joint each have a first height and at least one of said beads not joined to lap joint has a second height, said first height being less than said second height.

16. A flat heat-exchange tube according to claim 14, wherein said first height is less than said second height by an amount substantially equal to said thickness of said plate.

17. A flat heat-exchange tube according to claim 14, wherein said beads have a substantially cylindrical shaped surface.

18. A flat heat-exchange tube according to claim 14, further comprising at least one reinforcement protuberance inwardly protruding from one opposing surface portion and in contact with said other opposing surface portion.

19. A flat heat-exchange tube according to claim 14, wherein said lap joint is substantially coextensive with an integer number of said plurality of rows of said beads, said integer number being two or more.

20. A flat heat-exchange tube according to claim 14, wherein said lap joint forms a flat surface as part of said flat tube shape.

* * * * *